United States Patent [19]

Sequeira, Jr.

[11] Patent Number: 5,006,222

[45] Date of Patent: Apr. 9, 1991

[54] SOLVENT DEWAXING OF LUBRICATING OILS

[75] Inventor: Avilino Sequeira, Jr., Port Arthur, Tex.

[73] Assignee: Texaco Inc., White Plains, N.Y.

[21] Appl. No.: 526,745

[22] Filed: May 23, 1990

[51] Int. Cl.[5] ..... C10G 71/00; C10G 73/06

[52] U.S. Cl. ..... 208/33; 208/28; 208/187; 208/188; 208/311; 208/321; 208/37; 208/18

[58] Field of Search ..... 208/33, 28, 311, 321, 208/187, 188, 37

[56] References Cited

U.S. PATENT DOCUMENTS 3,001,604 9/1961 Worley ..... 208/187

3,096,380 7/1963 Bolen ..... 208/187

4,180,457 12/1979 Popp et al. ..... 208/188

*Primary Examiner*—Anthony McFarlane

*Assistant Examiner*—Nhat Phan

*Attorney, Agent, or Firm*—Jack H. Park; Kenneth R. Priem; Richard A. Morgan

[57] ABSTRACT

An improvement has been discovered in a process for solvent dewaxing a hydrocarbon lubricating oil stock. Solvent dewaxed oils are steam stripped and then vacuum dehydrated at 2.5 psia at the steam stripping temperature of 350° F. to 450° F. Nitrogen or natural gas having a dew point of −100° F. or lower is contacted with the oil at 0.5 to 1 SCF/bbl. A solvent free lubricating oil is produced which is water haze free in cold storage.

11 Claims, 1 Drawing Sheet

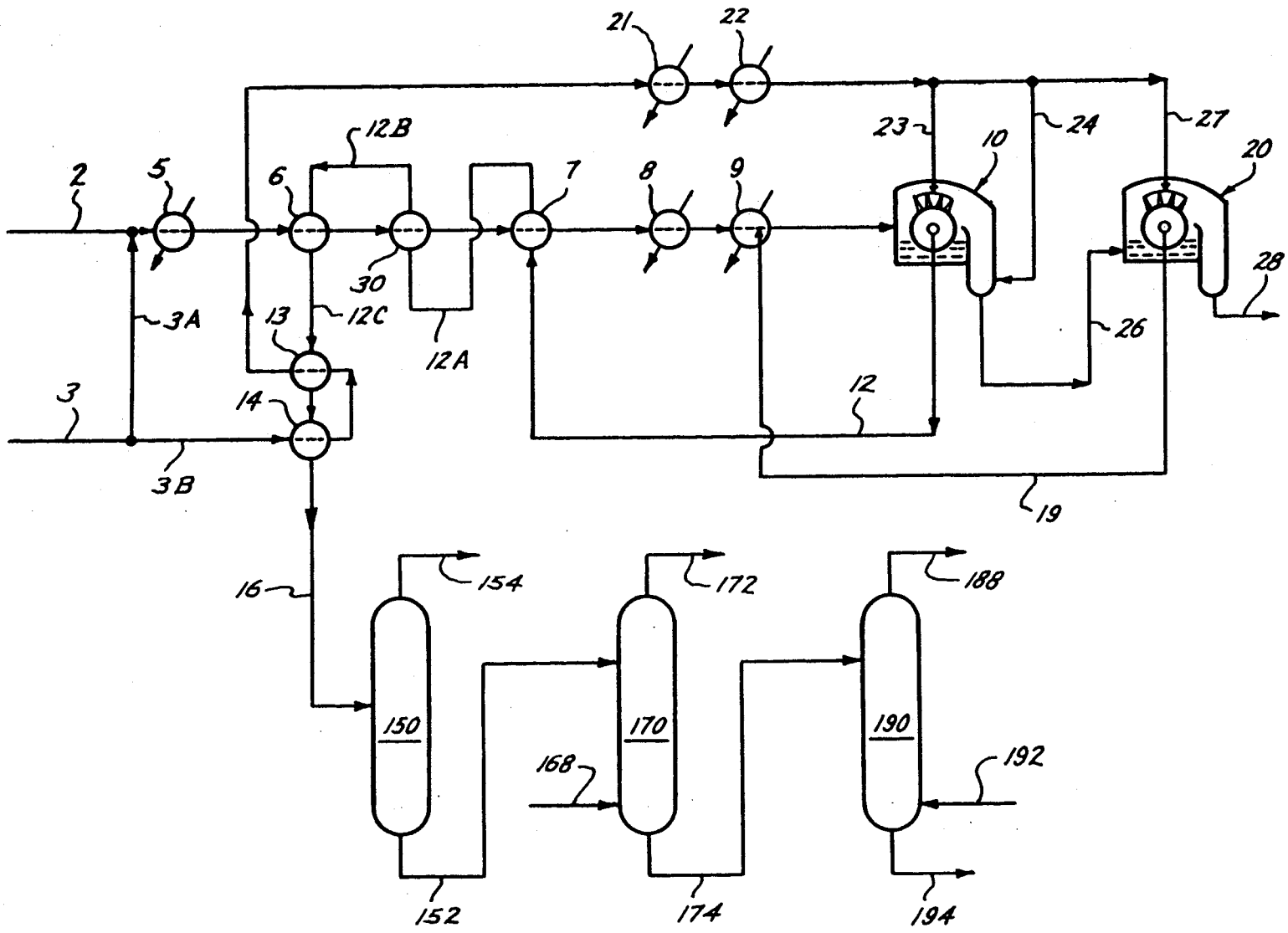
2
3
5
3A
3B
6
13
14
16
12B
12C
30
12A
7
8
9
21
22
12
10
23
24
27
20
28
26
19
150
152
154
170
168
172
174
190
188
192
194

SOLVENT DEWAXING OF LUBRICATING OILS

BACKGROUND OF THE INVENTION

1. Field Of The Invention

The invention relates to solvent dewaxing a petroleum derived lubricating oil stock. More particularly, the invention relates to the production of dewaxing solvent free lubricating oils by steam stripping. Most particularly, the invention relates to producing lubricating oils which are free of water haze on standing at subambient temperature.

2. Description Of the Related Arts

Waxy petroleum oil stocks are solvent dewaxed by cooling oil-solvent admixtures under controlled conditions for crystallization of wax from the admixtures. Commercially, such oil-solvent admixtures are cooled by several methods such as indirect heat exchange in scraped surface exchangers; dilution chilling wherein waxy oil stock is contacted in a multistage tower with chilled solvent under conditions of high levels of agitation, and direct chilling, wherein a low boiling solvent, e.g. propylene, mixed with waxy oil stock is vaporized under conditions of reduced pressure.

In such commercial processes, the waxy oil charge, or mixtures of waxy oil charge and dewaxing solvent, are heated to a temperature at which the wax is dissolved. The heated charge is then passed into a cooling zone wherein cooling is undertaken at a uniform slow rate in the range of about 1° to 8° F./min. (0.56° to 4.4° C./min.) until a temperature is reached at which a substantial portion of the wax is crystallized and at which dewaxed oil product has a selected pour point temperature. Upon achieving the desired dewaxing temperature, the mixture of wax crystals, oil and solvent is subjected to solid-liquid separation for recovery of a wax free oil-solvent solution and a solid wax containing a minor proportion of oil (slack-wax). The separated oil-solvent solution is subjected to distillation for recovery of a solvent fraction and a dewaxed oil product fraction. The slack wax may be recovered as is, or may be subjected to additional processing, such as repulp filtration for removal of additional oil therefrom.

Solid-liquid separation techniques which may be employed for separation of wax crystals from the oil-solvent solutions include known solid-liquid separation processes, such as gravity settling, centrifugation, and filtration. Most commonly, in commercial processes, filtration in a rotary vacuum filter, followed by solvent wash of the wax cake, is employed.

Dewaxing solvents which may be used in solvent dewaxing processes include known dewaxing solvents. Commonly used solvents include aliphatic ketones of 3-6 carbon atoms, $C_2$-$C_4$ range hydrocarbons, $C_6$-$C_7$ aromatic hydrocarbons, halogenated $C_1$-$C_4$ hydrocarbons, and mixtures of such solvents.

Solvents known to be useful as dewaxing solvents are the ketones containing 3 to 6 carbon atoms, for example, acetone, methylethylketone (MEK) and methylisobutylketone (MIBK); mixtures of ketones; and mixtures of ketones with aromatic hydrocarbons including benzene and toluene. Halogenated low molecular weight hydrocarbons, including dichloromethane and dichloroethane, and their mixtures are also known dewaxing solvents. Solvent dilution of waxy oil stocks maintains fluidity of the oil for facilitating easy handling, for obtaining optimum wax-oil separation, and for obtaining optimum dewaxed oil yields. The extent of solvent dilution depends upon the particular oil stocks and solvents used, the approach to filtration temperature in the cooling zone and the desired final ratio of solvent to oil in the separation zone.

For processes employing indirect cooling in scraped surface exchangers, cooling and wax crystallization are accomplished under conditions of very little agitation at a cooling rate in the range of about 1° to 8° F./min. (0.56° to 4.4° C./min. Under such conditions, without wall scrapers, wax tends to accumulate on the cold exchanger walls, interfering with heat transfer and causing increased pressure drop. Thus, wall scrapers are employed to remove the accumulated wax. Dewaxing solvents are employed to maintain fluidity of the oil in the coolers, and may be added before the oil is cooled or in increments during cooling. Often the oil is given a final dilution with solvent at the separation temperature for reducing solution viscosity such that wax separation is more efficient. Commonly, solvent added to the oil in such processes is at the same temperature, or somewhat higher temperature than the oil. Cold solvent, added at substantially lower temperatures than the oil, shock chills the oil resulting in formation of many small wax crystals which can be difficult to separate. Under controlled conditions, elongated wax crystals of good size are formed which are easy to separate and which contain little occlude oil.

Dilution chilling processes employ incremental addition of cold solvent, e.g. to +20° to −25° (−6.7° to −32° C.) to the oil at high degrees of agitation such that oil and solvent are completely mixed in less than one second. Under such conditions, wax precipitates in small, hard balls rather than elongated crystals. Such wax precipitates are easy to separate and retain very little oil.

Direct chilling processes employ a low boiling hydrocarbon, e.g. propylene, as dewaxing solvent and refrigerant. Waxy oil stock is diluted with sufficient low boiling hydrocarbon to provide the necessary cooling and provide the desired final dilution for separation of solid-wax from the oil-solvent solution. The low boiling hydrocarbon is vaporized from the oil-low boiling hydrocarbon solution, under conditions of reduced pressure, at a rate sufficient to cool the solution about 1° to 8° F./min. (0.56° to 4.4° C./min). Such cooling is continued until the desired separation temperature and amount of wax crystallization are obtained. At the separation temperature, sufficient low boiling hydrocarbon remains in solution with the oil to provide the desired fluidity for separation of wax. Agitation of the mixture being cooled is commonly provided for reduction of temperature and concentration gradients.

U.S. Pat. No. 3,972,779 to C. W. Harrison teaches a system for controlling a dewaxing apparatus. The system comprises a viscosity measurement of the waxy oil-wax crystal slurry mix and a refractive index measurement of the solvent to calculate incremental changes to dilution of wax oil with solvent.

U.S. Pat. No. 4,199,433 to H. 0. Button et al. teaches a continuous process for solvent dewaxing lubricating oil stocks. The objective of the process is to eliminate the steam stripping of products. In the process, an inert gas, such as nitrogen, is used as a stripping agent for removing solvent from dewaxed oils, deoiled waxes and slack waxes resulting from solvent dewaxing processes.

*Petroleum Refiner,* Vol. 15, No. 6, June 1936, pp. 205–209 discusses the useful art of solvent dewaxing and the terminology used by those trained in the art.

SUMMARY OF THE INVENTION

An improvement has been discovered in a process for solvent dewaxing a hydrocarbon lubricating oil stock. The lubricating oil stock is mixed with a dewaxing solvent to form an oil-solvent mixture. The mixture is chilled to dewaxing temperature, thereby crystallizing the wax. Crystalline wax is separated by filtration to yield a dewaxed oil-solvent mixture. The dewaxed oil-solvent mixture is steam stripped at a temperature in the range of 300° F. to 600° F. and a pressure of 1 atm to 3 atm to yield a solvent free dewaxed oil.

This solvent free oil is vacuum dehydrated by contacting with a dry inert gas having a dew point below about −100° F. at a contact rate of about 0.5 to 10 standard cubic feet/barrel (SCF/bbl). This is carried out at a temperature of 300° F. to 600° F., preferably 350° F. to 450° F. and a pressure of 0.2 to 16 psia, preferably 0.25 to 5 psia. As a result of the vacuum dehydration a solvent dewaxed lubricating oil is produced which is free of water haze at ambient temperature and below.

BRIEF DESCRIPTION OF THE DRAWING

The drawing is a schematic flow diagram of a lubricating oil solvent dewaxing process employing the process of the invention.

DETAILED DESCRIPTION OF THE DRAWING

A waxy petroleum distillate supplied through line 2 is prediluted with solvent from line 3 via line 3A at a temperature effective for complete solution of the oil in solvent. In commercial operations, predilution of solvent and oil is usually carried out at a temperature in the range of 32° C. to 70° C. The mixture is then cooled in heat exchanger 5 where it is cooled by indirect heat exchange with cooling water and then passed through heat exchangers and chillers 6, 30, 7, 8 and 9 where it is cooled to the desired dewaxing temperature and delivered to primary filter 10.

The chillers may comprise a plurality of scraped wall double pipe heat exchangers of the type well known in the art. Suitably, chillers 6, 30, 7, 8, and 9 consist of double wall heat exchangers well known in the art which comprise an inner pipe through which the solvent-oil mixture is passed surrounded by an outer pipe or jacket of larger diameter supplied with a suitable coolant or heat exchange fluid. Coolant, comprising a dewaxed oil and solvent mixture obtained as a cold filtrate from a rotary drum vacuum filter 10 is supplied to the annulus or jacket of chiller 7 through line 12 and thereafter to the jacket of chiller 30 through line 12 and chiller 6 through line 12 warming the filtrate and cooling the incoming mixture of oil and solvent. The resulting warmed filtrate then flows in sequence through heat exchangers 13 and 14 where it is further warmed by heat exchange with solvent from line 3 and passed through line 16 for processing to recover solvent.

The incoming mixture of oil feedstock and solvent is progressively cooled during its passage through heat exchanger-chillers 5, 6, 30, 7, 8 and 9 to the desired dewaxing temperature which may be in the range of −20° C. to −40° C. The resulting chilled mixture comprising solvent, dewaxed oil, and wax crystals is fed to primary filter 10. Additional solvent is added to the oil and solvent mixture through line 19, suitably as cold filtrate containing small amounts of low melting point wax and oil from repulp filter 20. Dilution of waxy petroleum oil stocks, especially lubricating oil base stocks, during the period of chilling and wax crystallization is a technique well known in the art. The cooling rate in the system of chillers 6, 30, 7, 8 and 9 is not greater than about 8° F. per minute, usually within the range of 1° F. to 6° F. per minute. Chillers 8 and 9 are cooled by a suitable refrigerant, e.g. ammonia or propane from a source not illustrated.

Chillers 6, 30, 7, 8, and 9 suitably comprise scraped wall heat exchangers and, although shown diagrammatically as single exchangers may each represent groups of heat exchangers, preferably of the double pipe type, and may comprise 20 to 24 double pipe heat exchangers arranged in four parallel banks and equipped with mechanical scrapers to remove paraffin accumulations from the inner wall of the inner pipe through which the mixture of oil and solvent is passed.

The resulting mixture of solvent, dewaxed oil, and wax crystals is further cooled in chillers 30, 7, 8, and 9 and supplied at the desired dewaxing temperature to primary filter 10. Filter 10 is preferably a rotary drum type vacuum filter wherein the mixture of dewaxed oil and solvent is drawn through the filter and solid wax is retained on the filter surface. Filtrate, comprising a mixture of dewaxed oil and solvent, is withdrawn from the primary filter 10 through line 12 to the outer pipe or jacket of chillers 7 and 30, and then through chillers 6, 13 and 14 as already described.

Fresh solvent from line 3B is cooled in heat exchangers 13 and 14 by indirect heat exchange with filtrate from primary filter 10 thereby heating the filtrate and cooling the solvent. From heat exchanger 13, the solvent is passed through chillers 21 and 22 where it is cooled to the desired filtration temperature by heat exchange with suitable refrigerant, e.g. ammonia or propane supplied to the heat exchangers from sources not illustrated in the drawing. The chilled solvent from line 3B is employed as wash liquid and wax repulping medium.

Wax cake accumulated on the surface of the filter drum of filter 10 is washed with cold solvent from line 23, removed from the primary filter in a continuous manner, mixed with additional cold solvent supplied by line 24 to form a slurry, and passed through line 26 to repulping filter 20. Oil retained in the wax cake discharged from the primary filter 10 is recovered in the repulping filter 20. The repulping filter 20 operates in a manner analogous to that of the primary filter 10 at essentially the same temperature as that of the primary filter 10 or at a slightly higher temperature, e.g. 2° C. to 5° C. higher than the temperature of primary filter 10. Repulp filtrate is withdrawn from repulping filter 20 through line 19. The repulp filtrate is added to the lubricating oil-solvent mixture in chiller 9 for dilution of the lubricating oil feedstock.

Wax cake accumulating on the filter in repulping filter 20 is washed on the filter with chilled clean solvent from line 27, removed from the filter in a continuous manner and discharged through line 28 as a wax product of the process. Solvent supplied to filters 10 and 20 through lines 23, 24, and 27 is precooled to dewaxing temperature.

The dewaxed oil mixture, comprising typically about 30 wt% dewaxed hydrocarbon oil in admixture with solvent is passed through line 12, passing through heat exchanger-chillers 7 and 30 and then passed sequentially through heat exchanger-chillers 6, 13 and 14. The mixture of dewaxed oil and solvent is passed through line 16 to flash tower 150.

Flash tower 150, a single tower in the drawing, is representative of a series of flash towers operated at different pressures to effect an optimal separation of solvent from raffinate. For example, flash tower 150 may represent a series of atmospheric, medium and high presure flash towers followed by vacuum flash tower. Alternatively, flash tower 150 may be the series of flash towers shown in U.S. Pat. No. 3,470,089 to H. C. Morris et al. incorporated herein by reference in its entirety. According to the Morris et al. patent, flash tower 150 represents an atmospheric flash tower, a pressure flash tower and finally a vacuum flash tower in series.

In another alternative, flash tower 150 represents a single vacuum flash tower. Vacuum flashed solvent is withdrawn overhead via line 154, condensed and passed to solvent accumulator (not shown).

The bottoms product of flash tower 150 is passed via line 152 to stripping tower 170. Super heated steam is passed via line 168 into stripping tower 170 to strip residual amounts of solvent from dewaxed oil. The overhead consisting of steam and stripped solvent is passed via line 172 to solvent drying (not shown).

As the result of steam stripping, a dewaxed oil free of solvent is recovered as a bottoms product. Residual amounts of 30 to 200 ppm water remain in the bottoms product. Bottoms product samples cooled to ambient temperature and below may have a visible water haze.

Bottoms is passed via line 174 to dehydration tower 190 wherein the water hazy dewaxed oil is contacted with a dry inert gas via line 192. This inert gas must have a dew point below about −100° F. and be in an amount of 0.5 to 10 SCF/bbl. Dehydration tower 190 is operated at a pressure of 0.2 to 16 psia, preferably 0.25 to 5 psia and a temperature of 300° F. to 600° F., preferably 350° F. to 450° F. by heat carried over from the steam stripper in condensate. As a result, a dewaxed oil free of water haze is passed via line 194 as a product. Inert gas and water vapor are passed via line 188 to a vacuum system (not shown) and vented.

DESCRIPTION OF THE PREFERRED EMBODIMENTS

In accordance with this invention it has been discovered that a petroleum based lubricating oil stock can be economically processed to yield solvent free, water haze free dewaxed oil.

Dewaxed oil is freed of a substantial portion of its solvent content by flash vaporization. Flash vaporization can be effected in a single vacuum flash tower. The vacuum flash vaporization may be preceded by a series of pressure or atmospheric flash vaporization towers with a final vacuum flash vaporization.

The vacuum flash tower is operated at a pressure within the range of 0.25 atm to 0.55 atm and a temperature in the range of 455° F. to 500° F. to yield a bottoms product substantially reduced in solvent, i.e. 5 vol% or less. The remainder of the solvent is removed by steam stripping.

The steam stripper is operated to yield a solvent free dewaxed oil as the bottoms product. The steam stripper is operated at a temperature in the range of 300° F. to 600° F. and pressure within the range of 1 atm to 3 atm. The steam stripper tower is typically a countercurrent vapor-liquid contact column provided with bubble cap trays in which the dewaxed oil flowing downwardly through the column is contacted with super heated steam introduced through a distributor positioned at the bottom of the column. A portion of the dewaxed oil from the bottom of the tower is cooled and returned to the upper portion of the tower as reflux.

A solvent free dewaxed oil is produced as a bottoms product which contains 50 parts per million (ppm) solvent or less, preferably 10 ppm or less. Dewaxed oil containing such low levels of solvent is referred to in the art as solvent free. This solvent free dewaxed oil also contains 30 to 200 ppm of water. On standing, samples allowed to cool to ambient temperature are hazy, due to the water content. This haze is termed "water haze" and is distinguished from the term "haze" which in the lubricating oil art typically refers to crystalline wax visible in samples.

The solvent free dewaxed oil is passed to a vacuum dehydration tower operated to yield a water haze free dewaxed oil as the bottoms product. The dehydration tower is operated at a temperature in the range of 300° F. to 600° F., preferably 350° F. to 450° F. and pressure within the range of 0.2 to 16 psia, preferably 0.25 to 5 psia. The dehydration tower is a countercurrent vapor-liquid contact column provided with 1 to 10 bubble cap trays or a packed column in which the dewaxed oil flowing downwardly through the column is contacted with a dry inert gas introduced through a distributor positioned at the bottom of the column.

In order to produce the desired water haze free product the inert gas must have a dew point of −100° F. (−73° C.) or less. Inert gases which are chemically inert to the lubricating oil and will not cause or leave color are acceptable. In practice, there are number of gases which are available in a refinery based lubricating oil plant which may be used such as nitrogen, helium, argon, carbon dioxide, natural gas, methane and mixtures thereof. Flue gas is a mixture of nitrogen and carbon dioxide.

It has been found that when the inert gas is added at a rate of about 0.5 to 10, preferably 0.5 to 1, standard cubic feet/barrel (SCF/bbl) of dewaxed oil that a haze free dewaxed oil product is produced.

Water haze in solvent dewaxed oils is not always apparent at room temperature. Haze free oils which are compounded with additives and shipped to cold climates have been found to turn hazy when exposed to ambient temperatures below about 40° F. Hazy lubricating oil is unsuitable for sale. Accordingly, solvent free, dewaxed samples are chilled and retained for 24 hours to detect a water haze as part of manufacturing quality control.

If a water haze is found to be present, it is routine in the industry to increase the vacuum, temperature or both in the final vacuum dehydration tower to remove water base.

Inventor has discovered that the addition of a dry inert gas with a dew point −100° F. or less in an amount of 0.1 to 10 SCF/bbl eliminated water haze without the requirement for additional capacity in the vacuum system. The water haze has been eliminated by reducing the water content of raffinates to 10 to 20 ppm.

This invention is shown by way of Example.

EXAMPLE

A solvent dewaxing system was operated according to the Drawing. Solvent was removed from a dewaxed oil-solvent mixture by vacuum distillation, steam stripping and vacuum dehydration.

The vacuum dehydrator was a one tray tower operated at a temperature of 350° F. to 450° F. by heat carried over from the steam stripper. The vacuum was in the range of 0.25 to 5 psia, with 2.45 psia typical. No inert gas was used.

Haze was found in samples of dewaxed medium neutral oil stored in a refrigerator at a temperature of 40° F. for 24 hours. Haze was also found in samples of bright stock stored according to the same procedure. The oils had been solvent dewaxed to a pour point of −12° C. with microscopic examination and chemical analysis of samples detected no wax crystals.

The vacuum was increased to the vacuum system limit, but this did not improve the haze in cold storage samples.

Dry nitrogen was bled into the lower portion of the dehydrator at a rate of 0.5 to 1 SCF/bbl. The nitrogen had a dew point below −100° F. The amount of nitrogen was small enough that the vacuum in the dehydrator did not vary from 2.45 psia. The water content of dewaxed medium neutral oil decreased from 25 ppm to 15 ppm. The water content of bright stock decreased from 30 -32 ppm to 15-18 ppm. The result was the elimination of haze from cold storage samples.

While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. In a process for producing a dewaxed lubricating oil from a wax-bearing mineral oil by the steps comprising:

mixing the oil with a dewaxing solvent thereby forming an oil-solvent mixture, chilling the oil-solvent mixture to a dewaxing temperature thereby crystallizing the wax and forming an oil-solvent-crystalline wax mixture, separating the oil-solvent-crystalline wax mixture to form a dewaxed oil-solvent mixture and crystalline wax, steam stripping the dewaxed oil-solvent mixture at a temperature of 300° F. to 600° F and pressure of 1 atm to 3 atm, to yield a solvent free dewaxed oil, the improvement which comprises:

contacting the solvent free dewaxed oil with an inert gas having a dew point about −100° F. or lower, at a contacting rate of about 0.5 to 10 SCF/bbl and dehydration pressure of about 0.2 to 16 psia, thereby yielding a dewaxed lubricating oil free of water haze.

2. The process of claim 1 wherein the inert gas is selected from the group consisting of nitrogen, helium, argon, carbon dioxide, natural gas, methane and mixtures thereof.

3. The process of claim 1 wherein the inert gas is nitrogen.

4. The process of claim 1 wherein the inert gas is natural gas.

5. The process of claim 1 wherein the contacting rate is 0.5 to 1 SCF/bbl.

6. The process of claim 1 wherein the dehydration temperature is about 300° F. to 600° F.

7. The process of claim 1 wherein the dehydration temperature is about 350° to 450° F.

8. The process of claim 1 wherein the dehydration pressure is about 0.25 to 5 psia.

9. The process of claim 1 wherein said solvent free dewaxed oil comprises at least 30 ppm water.

10. The process of claim 1 wherein said dewaxed lubricating oil free of water haze comprises 20 ppm water or less.

11. The process of claim 1 wherein said solvent free dewaxed oil comprises at least 30 ppm water and wherein said dewaxed lubricating oil free of water haze comprises 20 ppm water or less.

* * * * *